US006292144B1

(12) United States Patent
Taflove et al.

(10) Patent No.: US 6,292,144 B1
(45) Date of Patent: Sep. 18, 2001

(54) ELONGATE RADIATOR CONFORMAL ANTENNA FOR PORTABLE COMMUNICATION DEVICES

(75) Inventors: Allen Taflove, Wilmette, IL (US); Lena Vasilyeva, Belle Mead, NJ (US)

(73) Assignee: Northwestern University, Evanston, IL (US)

( * ) Notice: Subject to any disclaimer, the term of this patent is extended or adjusted under 35 U.S.C. 154(b) by 0 days.

(21) Appl. No.: 09/418,618

(22) Filed: Oct. 15, 1999

(51) Int. Cl.[7] ..... H01Q 1/24

(52) U.S. Cl. ..... 343/702; 343/700 MS; 343/828; 343/873

(58) Field of Search ..... 343/700 MS, 702, 343/828, 829, 846, 873; 455/90; H01Q 1/24, 1/36

(56) References Cited

U.S. PATENT DOCUMENTS

| | | | | |
|---|---|---|---|---|
| 4,123,756 | | 10/1978 | Nagata et al. | 343/702 |
| 4,816,836 | | 3/1989 | Lalezari | 343/700 |
| 5,365,246 | * | 11/1994 | Rasinger et al. | 343/702 |
| 5,555,459 | | 9/1996 | Kraus et al. | 343/702 |
| 5,559,522 | | 9/1996 | Seitz | 343/702 |

(List continued on next page.)

OTHER PUBLICATIONS

G. Lazzi, J. Johnson, S.S. Pattnaik, and O.P. Gandhi "Experimental Study on Compact, High–Gain, Low SAR And Single–And Dual–Band Patch Antenna For Cellular Telephones", Proc. 1998 IEEE Antennas and Propagation Society International Symposium, Jun. 21–26, 1998, Atlanta, Georgia, pp. 130–133.

S.C. Pan and K.L. Wong, "Design of Dual–Frequency Microstrip Antennas Using a Shorting–pin Loading", Proc. 1998 IEEE Antennas and Propagation Society International Symposium, Jun. 21–26, 1998, Atlanta, Georgia, pp. 312–315.

(List continued on next page.)

*Primary Examiner*—T. Phan
(74) *Attorney, Agent, or Firm*—Greer, Burns & Crain, Ltd.

(57) ABSTRACT

An elongate radiator conformal antenna for portable communication devices is conformed on or in dielectric. The antenna of the present invention is a conformal antenna having an elongate radiator element grounded to a ground plane generally opposite the elongate radiator element, and driven by a feed connected to the elongate radiator element at a point between its connection to the ground plane and its open end. The elongate radiator element and ground plane are conformed with dielectric which, due to its wavelength shortening effect, reduces the required length of the elongate radiator element to less than a quarter wavelength. The dielectric material with which the antenna is conformed and any additional dielectric material between the elongate radiator element and the ground plane is preferably high permittivity and low loss tangent material. The antenna may include multiple elongate radiator elements for multiple or broad band operation with each of the elongate radiator elements being shorter than a quarter wavelength for its respective operating frequency. The elongate radiator elements are mostly opposite a ground plane, with ground ends of the elongate radiator elements being connected to the ground plane. The antenna is conformed with dielectric which can conform to a portable communication device without adding substantially to its dimensions. Operation of the separate elongate radiator elements in multiband embodiments of the invention is automatic since the elongate radiator elements will be operative only for their respective frequency bands without further control. Elongate radiator elements not tuned to the instantaneous frequency of operation provide substantial mismatch to the transmitter and receiver of the communication device despite their close proximity to other ones of the multiple elongate radiator elements.

23 Claims, 7 Drawing Sheets

U.S. PATENT DOCUMENTS

| | | | | |
|---|---|---|---|---|
| 5,777,585 | | 7/1998 | Tsuda et al. | 343/702 |
| 5,821,903 | | 10/1998 | Williams | 343/702 |
| 5,841,402 | | 11/1998 | Dias et al. | 343/702 |
| 5,841,403 | | 11/1998 | West | 343/702 |
| 5,852,421 | | 12/1998 | Maldonado | 343/702 |
| 5,854,970 | | 12/1998 | Kivela | 455/90 |
| 5,886,668 | | 3/1999 | Pedersen et al. | 343/702 |
| 5,966,097 | | 10/1999 | Fukasawa et al. | 343/700 |
| 5,977,916 | * | 11/1999 | Vannatta et al. | 343/702 |
| 6,040,803 | * | 3/2000 | Spall | 343/700 MS |

OTHER PUBLICATIONS

S.H. Al–Charchafchi and B.M. Al–Arjani, "Microstripline Fed Compact Patch Antenna", Proc. 1998 IEEE Antennas and Propagation Society International Symposium, Jun. 21–26, 1998, Atlanta, Georgia, pp. 668–671.

R.B. Waterhouse, D.M. Kokotoff and F. Zavosh, "Investigation of Small Printed Antennas Suitable For Mobile 1998, Communication Handsets", Proc. 1998 IEEE Antennas and Propagation Society International Symposium, Jun. 21–26, Atlanta, Georgia, pp. 1946–1953.

J.H. Lu and K.P. Yang, "Slot–Coupled Compact Triangular Microstrip Antenna With Lumped Load", Proc. 1998 IEEE Antennas and Propagation Society International Symposium, Jun. 21–26, 1998, Atlanta, Georgia, pp. 916–919.

H. Nakano, N. Ikeda, Y.Y. Wu, R. Suzuki, H. Mimaki, J. Yamauchi, "Realization of Dual–Frequency and Wide–Band VSWR Performances Using Normal–Mode Helical and Inverted–F Antennas", IEEE Trans. Antennas and Propagation, vol. 46, Jun. 1998, pp. 788–793.

* cited by examiner

10
OPEN-CIRCUITED ENDS
12a1
12a2
12aK
12aN
121
122
12K
12N
l1
l2
lK
lN
l'1
l'2
l'K
l'N
COAXIAL CABLE (15) FEEDPOINT TO TRANSMITTER/ RECEIVER
14
16
18
50Ω MICROSTRIP LINE FEED TO ALL ELEMENTS
CONNECTION BETWEEN STRIPLINE AND K'th ELEMENT (SEE Fig. 3)
GROUND POINTS (SEE Figs. 2 & 3)
ELEMENT #1 X=X1 (lowest frequency, f1)
ELEMENT #2 X=X2 f2>f1
ELEMENT #K X=XK fK>fK-1
ELEMENT #N X=XN (highest frequency, fN)
x
y
2
3
LEFT SIDE VIEW
FRONT SIDE VIEW LEFT SIDE VIEW OF Figs. 1 & 3, SHOWING THE k'th RADIATING ELEMENT FRONT SIDE VIEW OF Figs. 1 & 2

ELONGATE RADIATOR CONFORMAL ANTENNA FOR PORTABLE COMMUNICATION DEVICES

FIELD OF THE INVENTION

The invention generally concerns portable communication antennas. The invention particularly concerns antennas for portable communication devices.

BACKGROUND OF THE INVENTION

One trend is toward the expansion of capabilities of portable communication devices. This includes the merger of formerly separate devices, such as cell phones and organizers, and the expansion of the capabilities of individual devices, such as the use of a single cell phone for more than one band of operation, e.g., AMPS and PCS bands, or the addition of voice communications, paging or other functions to phones, data terminals and other portable communication devices. As the delivery of services to communication devices and the capability of communication devices increases, the need for bandwidth of operation similarly increases. Voice communications may occur on one or more operational bands, E-mail communications on another, news information on yet another and so on.

A conflicting trend is the reduction in size of portable communication devices. A major impediment to the reduction in size is the need to include an antenna, typically in the form of a whip, helix or a combination of both, that has a length corresponding to a half or quarter of the wavelength of the operational frequency. Dual band operations typically require a switching between multiple radiators in such a whip/helix antenna structure. Expansion beyond two bands, if it can be accomplished at all, adds even more complexity. In addition, the general nature of an extendable whip with or without a helix requires the communication device to have a length which is equal or close to the length of the whip to permit its retraction and extension. The whip style antennas also suffer from reliability problems. They break, bend, and can wear from cycling, to the point where electrical contact to communication device circuits as intended becomes unreliable.

One solution to this problem has been the use of conformal patch antennas. These antennas obviate the need for an extendable whip, and in some forms can provide dual band operation. The general structure of the antenna is a patch area separated from a ground plane, generally referred to as a planar inverted F (PIFA) structure in the art. The difficulty with the patch style antenna is its size and shape. Patches in portable communication devices require a ground plane which extends slightly beyond the perimeter defined by the patch. This makes placement of the antenna, typically within the communication device, difficult to accommodate. The area of the patch is also likely to be blocked, at least partially, by a user's hand during operation.

Thus, there is a need for an improved conformal antenna for portable communication devices which meets the need for adequate radiation performance, is reliable, and does not add significantly to the dimensions of the portable device. Due to the increasing services offered by portable communication devices, such an improved antenna should be expandable to multiple bands, and should be capable of broad band operation. These and other needs are met or exceeded by the multiband antenna of the present invention.

SUMMARY OF THE INVENTION

The antenna of the present invention is a conformal antenna having an elongate radiator element grounded to a ground plane generally opposite the elongate radiator element, and driven by a feed connected to the elongate radiator element at a point between its connection to the ground plane and its open end. The elongate radiator element and ground plane are conformed with dielectric which, due to its wavelength shortening effect, reduces the required length of the elongate radiator element to less than a quarter wavelength. Conformed with dielectric, as used herein, means on or within the surface of the dielectric. The dielectric material with which the antenna is conformed and any additional dielectric material between the elongate radiator element and the ground plane is preferably low loss tangent material.

The elongate radiator element of the present antenna can be formed as a strip or wire. Its elongate nature and the overall design of the present invention permit simple expansion beyond a single band and simple broad banding operation through use of additional generally parallel elongate radiator elements. The additional elongate radiator elements may be commonly connected to a feed element, such as a microstrip disposed generally perpendicular to the elongate radiator elements, or separate feed elements to each elongate radiator are possible. The elongate radiator elements have different lengths for different bands. Any particular one of the elongate radiator elements is shorter than the quarter wavelength for the center frequency of its corresponding band of operation. Broad banding is obtained by multiple length elements stagger tuned, by their length, to closely staggered or slightly overlapping bands of operation.

The antenna is a suitable replacement for external whip antennas commonly used in portable communication devices such as cell phones and personal communication systems. It is preferably conformed with dielectric which conforms to a portion of an outer surface of the communication device, in a location which should be away from portions that are typically grasped in a user's hand. Such a location is feasible, in part, due to the small footprint of the antenna of the invention. In a multiband embodiment, despite close proximity of the multiple elongate radiator elements, only the elongate radiator element tuned by its length to the instantaneous operating frequency band will be active due to the substantial impedance mismatches of the remaining elements to the transmitter/receiver of the communication device.

BRIEF DESCRIPTION OF THE DRAWINGS

Other features, objects and advantages of the invention will be apparent to those skilled in the art by reference to the detailed description, and the drawings, of which.

DETAILED DESCRIPTION OF THE INVENTION

The invention is an N-band, N-elongate conformal elongate radiator element antenna, having an inverted-F shape, for use with portable communication devices. The antenna is conformed, i.e., on a surface of or within, dielectric material for conformally mounting to a portable communication device. The dielectric material has a wavelength shortening effect which reduces the required length of an elongate radiator element of the present antenna to less than the quarter wavelength for a center frequency of its corresponding band of operation.

Figure 1:
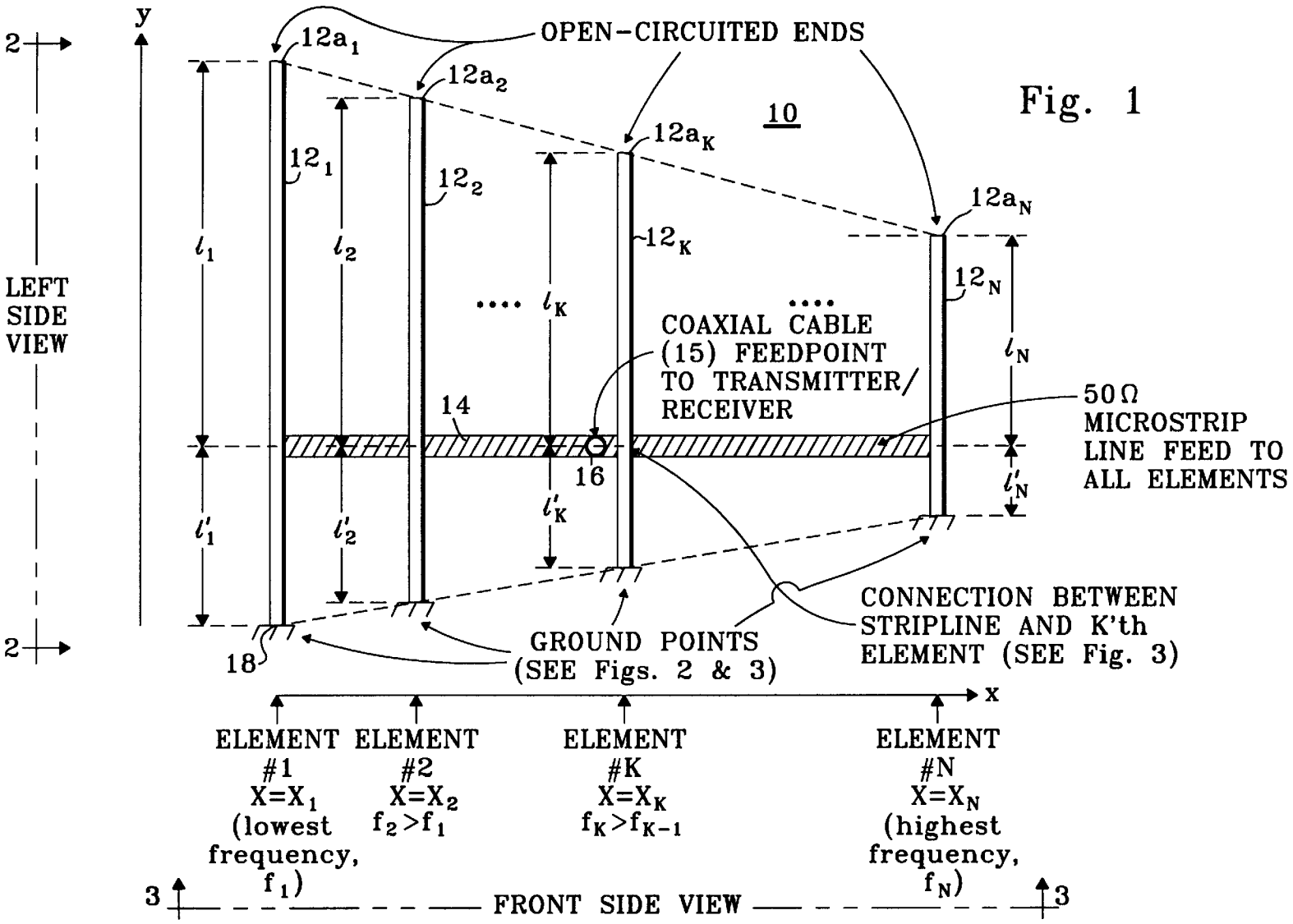
FIG. 1 is a schematic front side view of a N band and N elongate radiator element antenna according to the invention.
Figure 2:
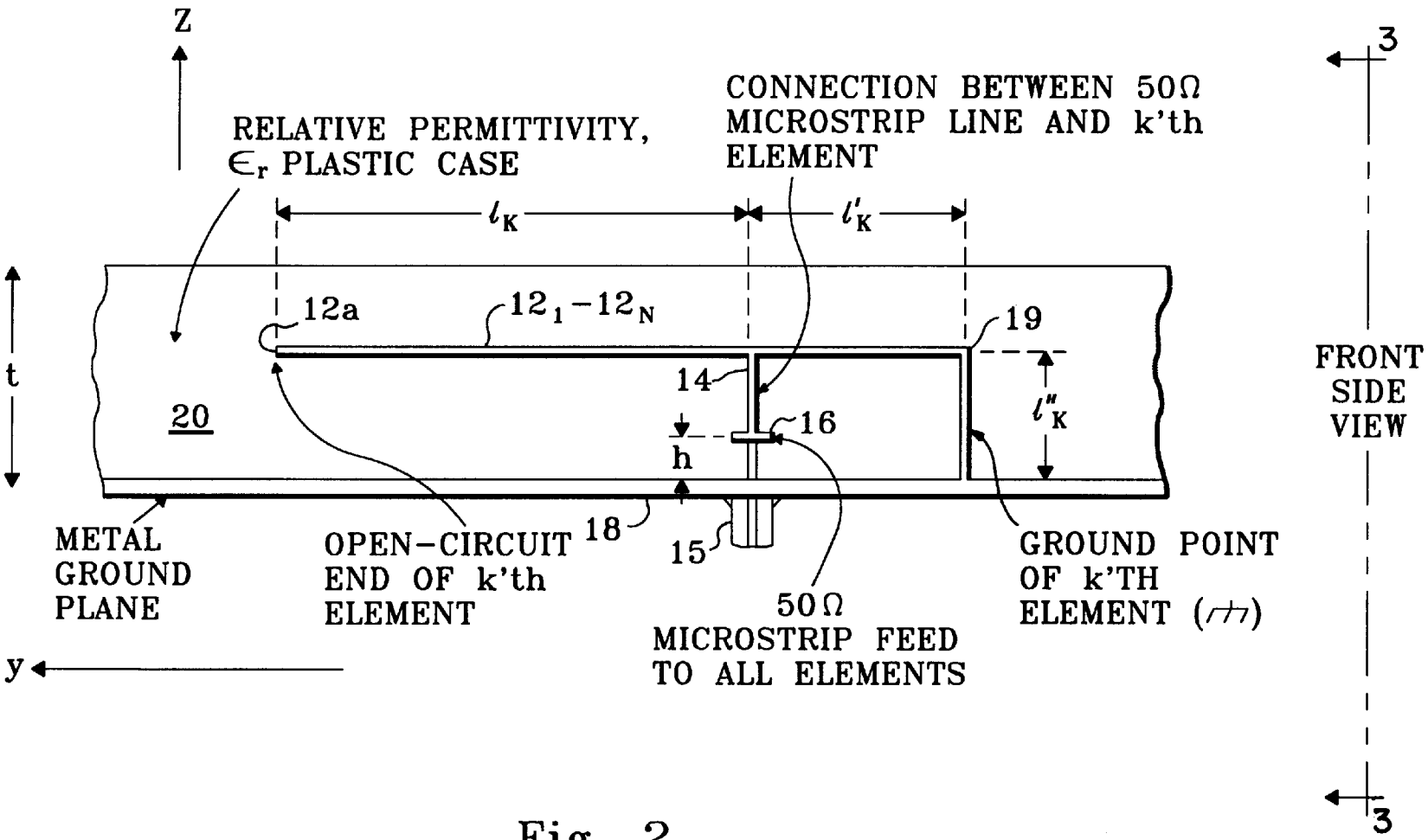
FIG. 2 is a schematic side view of the antenna of FIG. 1.
Figure 3:
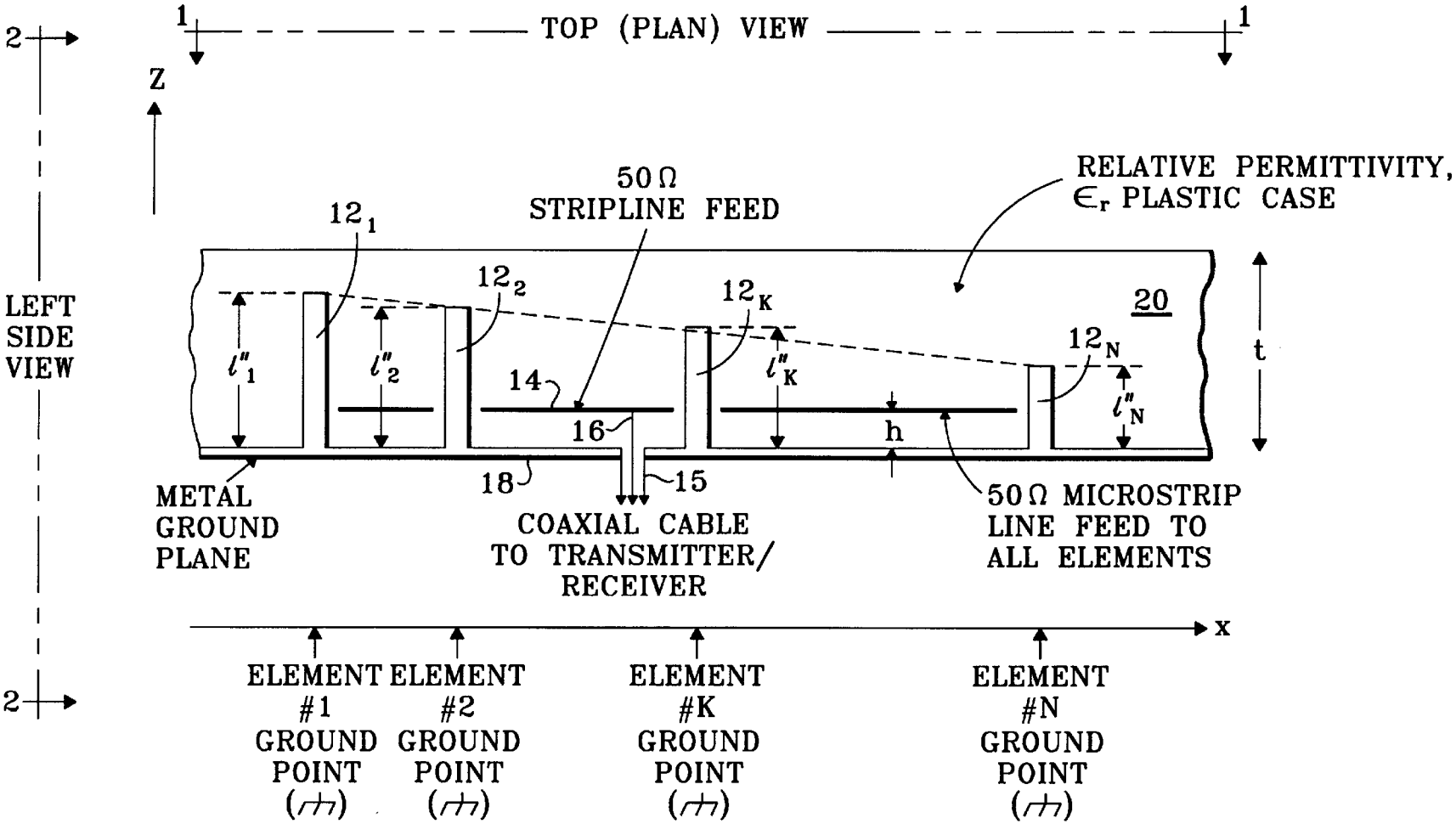
FIG. 3 is a schematic alternate side view of the antenna of FIG. 1.

Referring now to the drawings, in particular to FIGS. 1–3, a schematic representation of the present antenna 10 is shown. In the drawings, the generic case of the present antenna 10 is shown for purposes of complete description. In other words, the drawings depict an N band antenna where N is greater than one. However, an embodiment of the invention includes a single band antenna, i.e., the case where N is equal to one.

The preferred embodiment multiband antenna 10 has a number of different length elongate radiator elements $\mathbf{12}_1$–$\mathbf{12}_N$, equal to the number of bands provided by the antenna. The elongate radiator elements $\mathbf{12}_1$–$\mathbf{12}_N$ are generally parallel and connected to a feed element 14 that is generally perpendicular to the elongate radiators. The feed element 14 is illustrated as being below the plane in which the elongate radiator elements $\mathbf{12}_1$–$\mathbf{12}_N$ are generally disposed. This prevents the feed element 14 from radiating by locating it proximately to a ground plane 18. Practically, the manufacture of the present antenna may be simplified, in some cases, by having the feed element 14 in the same plane as the elongate radiator elements $\mathbf{12}_1$–$\mathbf{12}_N$. The out of plane feed element 14 is preferred, though, since radiation by the feed element 14 might interfere with the radiation pattern of the radiating elements $\mathbf{12}_1$–$\mathbf{12}_N$.

A connection to the feed element 14 is made by a coax 15 or other suitable conductor at a feed point 16. Ground (for both the coax and the elongate radiator elements) is a ground plane 18, generally disposed opposite the elongate radiator elements $\mathbf{12}_1$–$\mathbf{12}_N$ and separated by space. The elongate radiator elements $\mathbf{12}_1$–$\mathbf{12}_N$ primarily occupy a space separate from that occupied by the ground plane 18. A portion of the elongate radiator elements $\mathbf{12}_1$–$\mathbf{12}_N$ bridges the separation, as seen in FIG. 2, to connect the elongate radiator elements $\mathbf{12}_1$–$\mathbf{12}_N$ to the ground plane 18. The footprint of the ground plane 18 is just large enough to encompass that of the elongate radiator elements. There is no need to extend the ground plane significantly past the foot print of the elongate radiator elements, permitting the overall antenna to have a compact elongate footprint defined by an area large enough to encompass the elongate radiator elements. The footprint of the ground plane is generally on the same order of magnitude as that of the elongate radiator elements $\mathbf{12}_1$–$\mathbf{12}_N$.

The feed to the elongate radiator elements $\mathbf{12}_1$–$\mathbf{12}_N$ via feed element 14 is at a point between their connection to the ground plane and respective open ends of the elongate radiator elements $\mathbf{12}_1$–$\mathbf{12}_N$. As explained in more detail below, the feed to the elongate radiator elements $\mathbf{12}_1$–$\mathbf{12}_N$ should be set such that the inductive admittance due to the shorted end of elongate radiator element is approximately canceled by the capacitive admittance due to the open-circuited end of the element, yielding a net resistive load.

Thin dielectric material 20 that supports or encases the remaining portions of the antenna 10 can be conformally mounted on the case of the portable communication device. The antenna 10 is driven, unbalanced, relative to the radio frequency ground reference for the portable communication device. Typically, a portable communication device includes a grounding shell coating the underside of the dielectric case that serves as the radio frequency reference for the portable communication device. Similarly, the antenna 10 may be formed within dielectric casing of a portable communication device, or a portion which completes the casing of the portable communication device, or even within a casing of the portable communication device.

The antenna 10 permits operation of an associated portable communicator within N frequency bands. Each elongate radiator element $\mathbf{12}_1$–$\mathbf{12}_N$ is constructed of round metal wires or narrow flat metal strips and is tuned (adjusted in its characteristic lengths) for a particular operating band. Generally, the length of the elements should be at least 5 times the width and preferably above 10 times the width. Ratios of 30:1 or more are easily realized in practice, and permit close spacing of multiple generally parallel elongate radiator elements without requiring a large footprint. Flex circuit construction techniques are a convenient method to produce such a conformal structure. The elongate radiator elements $\mathbf{12}_1$–$\mathbf{12}_N$ are generally parallel and connected to the feed element 14, which is preferably a single 50α microstrip transmission line oriented perpendicular to the elongate radiator elements $\mathbf{12}_1$–$\mathbf{12}_N$ In FIGS. 1–3, the feed element 14 is shown below the elongate radiator elements $\mathbf{12}_1$–$\mathbf{12}_N$, but it may be in the same plane, as discussed above. This feed element 14 is connected to a feed, preferably coax cable 15, that penetrates the grounding shell to reach the interior transmitter/receiver electronics and is grounded to the ground plane 18.

During operation, only the particular inverted-F elongate radiator element tuned to the instantaneous operating frequency band is active. All other inverted-F elements present substantial impedance mismatches to the transmitter/receiver and are essentially inactive despite their close proximity to the tuned active element. The multiband embodiment of the present antenna 10 therefore provides an automatic switching between operational bands.

The antenna of the invention provides smaller length elongate radiators since the inverted-F elongate radiator elements, mounted on or within the dielectric material 20 in accordance with the invention, is reduced for each of the N elongate radiator elements relative to that which would be required for good operation free space due to the wavelength-shortening effect of the dielectric. In its preferred geometry, the spacing between adjacent parallel elongate radiator elements is much less than the length of the elongate radiator elements. The resulting narrow elongate "footprint" of the antenna 10 is compatible with the shape and available space along the top surfaces of typical small portable communications devices. It allows the elongate radiator elements $\mathbf{12}_1$–$\mathbf{12}_N$ to extend along a width of the portable communicator casing, or down a small portion of the length of the casing, reducing the chance of interference from a user's hand.

This provides flexibility as to the orientation of the elongate radiator elements $\mathbf{12}_1$–$\mathbf{12}_N$ with respect to the communication device, allowing a radiation pattern to be established to reduce the chance of interference of the user's head by placing the user's head in a null of the radiation pattern. A specific preferred orientation is having the elongate radiator elements $\mathbf{12}_1$–$\mathbf{12}_N$ generally parallel to or within the back plane of a communication device, i.e. the surface facing away from a user's head during operation. This creates a radiation pattern similar to that which would be obtained by a whip antenna that horizontally extends out of the back plane of the portable communication device. Such a pattern should reduce losses due to the head of the user by placing the head in a null of the radiation pattern. This improves performance and avoids directing radiation into the head. The latter result is a desirable goal apart from performance gains. It is impractical to realize with a whip antenna, but is enabled by the antenna of the invention.

Placement of the antenna 10 is preferably at the top portion of small portable communications devices since this location reduces the possibility of a user's hand covering the case in the vicinity of the antenna. The small geometry and small space occupied by the antenna 10 therefore better avoids signal-attenuation problems faced by other conventional case-embedded antenna designs (such as square or triangular PIFA patches) wherein the antenna footprint allows its placement only along the broad back wall of the case which is gripped by the user's hand. Covering of a case-mounted antenna by the user's hand significantly attenuates the transmitted and received signals and subjects the user to possible RF heating of his/her hand when transmitting.

Optimal multiband operation of the antenna 10 is obtained by tapering each dimension (the characteristic lengths on either side of the feed element 14, the overall length, and the distance from ground plane) of the elements across the array approximately inversely with their frequency of operation. This ideal case is illustrated in FIGS. 1 and 3. In FIGS. 1–3, $l_k$,$l'_k$, and $l''_k$ respectively refer to the length between the open end 12*a* and feed element 14, the length between a ground drop point 19 and feed element 14, and the height of the elongate radiator element with respect to the ground plane 18, i.e., the length between the ground plane 18 and the ground drop point 19. Different geometries from those shown in FIGS. 1–3 can be used to obtain the length tapers. For example, skewing the angle of the feed element 14 from perpendicular will taper both $l_k$,$l'_k$ in the case where the ground plane presents a perpendicular connection point for parallel elongate radiator elements. Other geometries to accomplish length tapers are also suitable. The height $l''_k$ may be difficult to taper in practice, but keeping it constant is acceptable.

In general, the elongate nature of the elongate radiator elements $\mathbf{12}_1$–$\mathbf{12}_N$ provides for flexibility in choice of location, and, apart from establishing a desired radiation pattern, the primary determinative factor as to placing the antenna should be avoiding interference of a user's hand. The number of multiple bands can be high.

Assuming that the center frequency of the kth element is $f_k$, then the characteristic element lengths, $l_k$, $l'_k$, and $l''_k$ defined in FIGS. 1–3 are given approximately by $$l_k \approx l_1 \cdot (f_1/f_k);\ l'_k \approx l'_1 \cdot (f_1/f_k);\ l''_k \approx l''_1 \cdot (f_1/f_k) \tag{1}$$

where $f_1$ is the center frequency of the lowest operating band. This implies that the higher-frequency elongate radiator elements are ideally both physically shorter and closer to the ground plane than the lower-frequency elements. For ease in manufacturing while achieving acceptable performance, however, the feeding microstrip line can be kept at a fixed height, h, above the ground plane. Similarly acceptable performance can also be achieved by fixing $l''_k$ while scaling $l_k$ and $l'_k$ as in (1).

The approximate resonance condition for the kth inverted-F elongate radiator element at $f_k$ is given by the following pair of relations.

1. The total length of the kth element is approximately equal to the average of the electrical quarter-wavelengths at $f_k$ within the air and within the thin dielectric material enclosing the antenna:

$$l_k + l'_k + l''_k \approx \frac{1}{2}\left(\frac{3.0\times10^8}{4f_k} + \frac{3.0\times10^8}{4\sqrt{\epsilon_r}\,f_k}\right) \tag{2}$$

where $\epsilon_r$ is the relative permittivity of the dielectric. Equation (2) is a consequence of the division of the electromagnetic field generated by the elongate radiator element between passage through the dielectric and through the air outside of the dielectric. Adjustment of the total element length about this nominal value results in a desired dip of the standing wave ratio at $f_k$, the center frequency of the kth frequency band.

2. The point of connection of the kth element to the microstrip feedline is approximately equidistant between the open and shorted ends of the element:

$$l_k \approx l'_k + l''_k \tag{3}$$

At this feedpoint position, the inductive admittance due to the shorted end of the element is approximately canceled by the capacitive admittance due to the open-circuited end of the element, yielding a net resistive load. Adjustment of the feedpoint about this nominal position results in a match to the feeding 50-ohm microstrip transmission line.

A number of observations are worthwhile concerning application of the antenna 10 of the invention in practice. Attention should be given to the dielectric material used to conform the antenna, as implied by equation (2) above. Dielectrics having higher relative permittivity reduce the total length required for any one of the elongate radiator elements. Increasing the permittivity past a certain point could, however, increase the quality factor (Q) of the system to an undesirably high level. Therefore, there will be an optimum range of permittivities representing a tradeoff between the total length and the quality factor (Q). Plastics are the typical dielectric used for the casings and other outer portions of most portable communicators. If plastics are used for the dielectric material, it is preferred that low carbon plastics be used as dielectric material to which the antenna is conformed because of their favorable loss tangent. A drawback to such plastics is their translucent nature, but this can be overcome through dyes, paint coatings or other suitable techniques if an opaqueness of the dielectric is desired. Any low loss dielectric material possessing suitable mechanical qualities is a preferred candidate with which the present antenna can be conformed. Other exemplary preferred dielectric materials include ceramics and ceramic-plastic composites.

The distance between the ground plane 18 and elongate radiator elements $\mathbf{12}_1$–$\mathbf{12}_N$, will affect performance. As the distance is increased, performance of the antenna will benefit through a broadening of the operational bands. Some mountings which might increase this distance could result in portions of the communication device being between the ground plane 18 and the elongate radiator elements $\mathbf{12}_1$–$\mathbf{12}_N$. Any additional dielectric which intervenes between the ground plane 18 and elongate radiator elements $\mathbf{12}_1$–$\mathbf{12}_N$, should also have low loss tangent.

Figure 4:
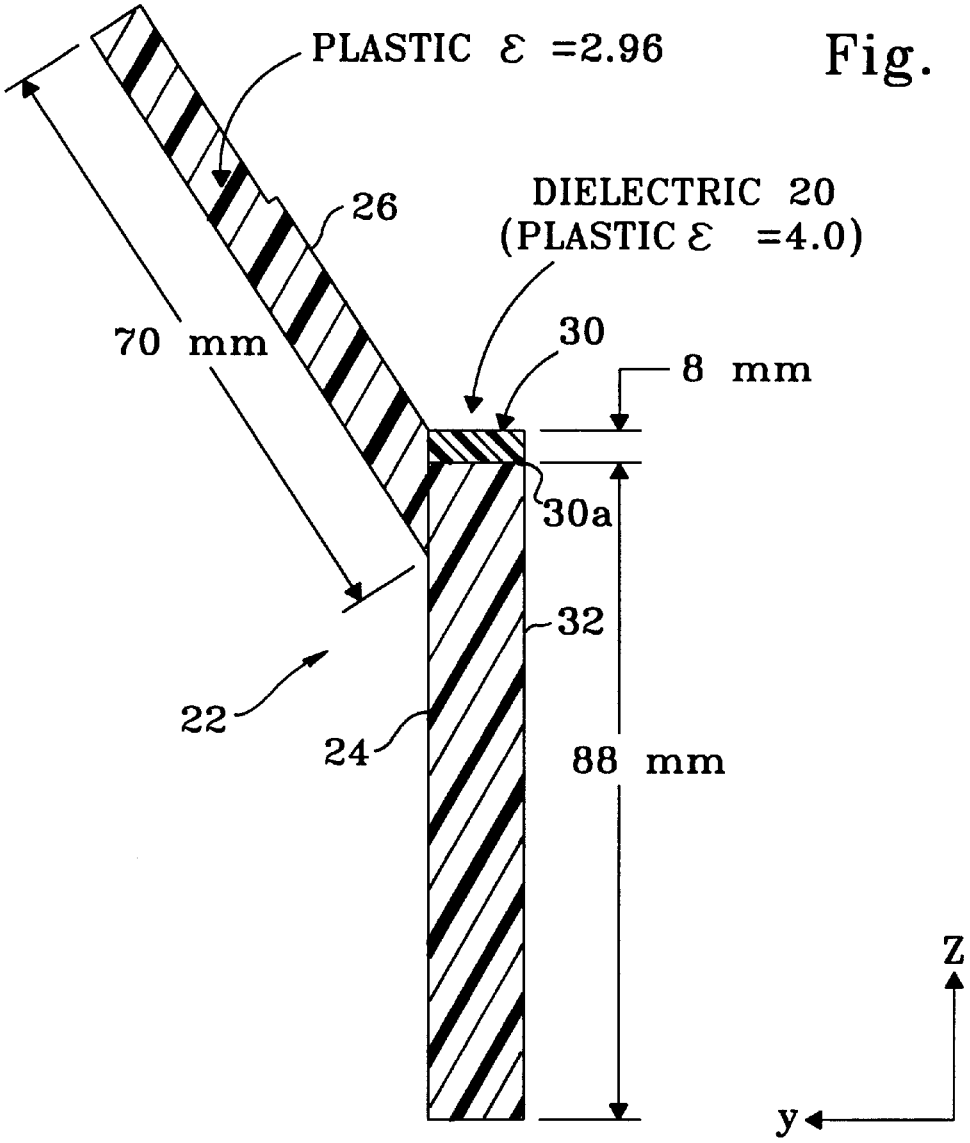
FIG. 4 illustrates an embodiment of an antenna of the invention applied to a hinged case communication device.
Figure 5A:
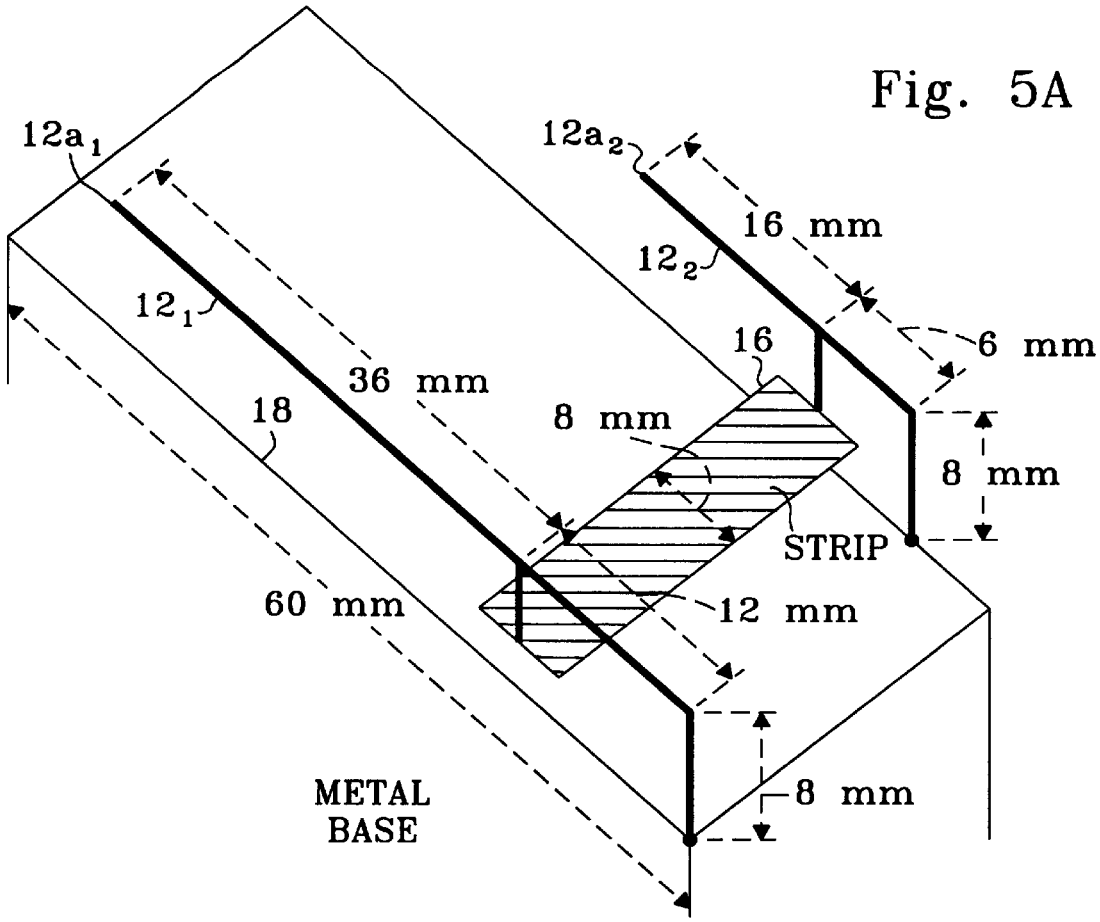
FIGS. 5*a* and 5*b* are schematic representations of the antenna structure for the antenna of FIG. 4.
Figure 5B:
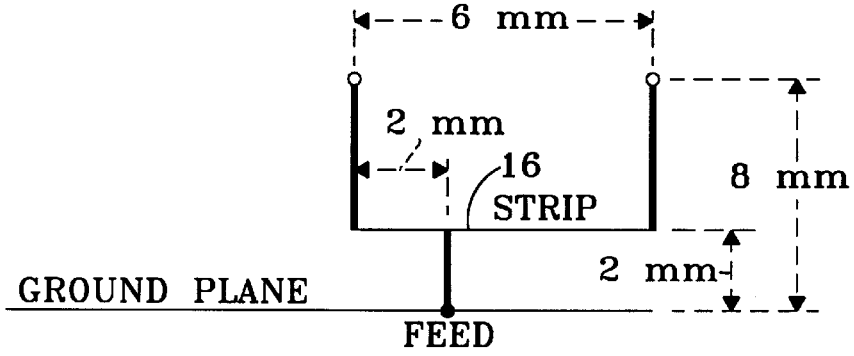

FIGS. 4 and 5 illustrate a specific application of the antenna of the invention as a two-element antenna array conformed within an 8 mm-thick dielectric slab ($\epsilon_r$=4) that can be conformally mounted on the top of the case of a hinged transceiver 22 case, such as the Motorola STAR- TAC® cell phone. Antenna dimensions are selected to provide dual-band operation centered at the 850 MHZ AMPS cellular band and 1.8 GHz PCS band:

$l_1$=36 mm; $l'_1$=12 mm; $l''_1$=8 mm $l_2$=16 mm; $l'_2$=12 mm; $l''_2$=8 mm $x_2$–$x_1$=6 mm; h=2 mm

The transceiver 22 includes a lower section 24 hinged to an upper section 26. The lower section 24 typically includes a microphone, electronics, keypad, display, etc., while the upper section 26 typically houses a speaker for a user's ear. Dimensions given in FIGS. 4 and 5 are for purposes of modeling performance of an exemplary application of the invention and do not, in any way, limit the invention. The dimensions of the transceiver 22 approximate a Motorola STAR-TAC® phone. Similarly, the relative permittivity $\epsilon$=2.96 is that of a typical carbon plastic casing. Dielectric 20 with antenna 10 is conformed to the top of the lower section 24. This is a convenient location, but others may be chosen with the goal being reducing the likelihood that a user will cover the area of the dielectric 20 during use. Elongate radiator elements $\mathbf{12}_{1-12N}$ are disposed in or on a side 30 that faces away from the lower section 24 with the ground plane 18 being adjacent or near the top part of the upper portion. An alternative preferred placement of the elongate radiator elements is in or on a side 30*a* that is in the same plane as the back surface 32 of the lower section 24 with the ground plane disposed on an opposite side. In both cases, the elongate radiator elements $\mathbf{12}_{1-12N}$ extend across a width of the lower section 24 (into the page in FIG. 4). In the latter case with the elongate radiator elements in or on side 30*a*, a radiation pattern is established similar to that which would be realized by having a whip antenna extending away from the back surface 32 horizontally. Numerical simulations and some testing indicates that this pattern reduces losses from a user's head, as the head is placed in a null of the pattern. In other words, the radiation pattern for the placement on or in side 30*a* should have a generally vertical orientation with lobes that primarily avoid a user's head and the placement on or in side 30 has a generally horizontal orientation with a lobe that intersects with a user's head.

A detailed computational electromagnetics model was implemented for the exemplary antenna shown in FIGS. 4 and 5 with the location of the elongate radiator elements on surface 30. We used our laboratory's (the Computational Electromagnetics Laboratory at Northwestern University) well-established three-dimensional finite-difference time-domain (FDTD) software for the solution of Maxwell's equations. The grid resolution for the FDTD model was a uniform 2 mm, which permitted excellent geometric detail of the antenna and the Motorola STAR-TAC® interior and exterior structural features to be incorporated in the model. Key Motorola STAR-TAC® features modeled included the slant and composition of the flip part of the phone, the location and size of the battery pack on the flip part, the location and size of the main circuit board, the wires connecting the battery pack to the main circuit board, and the case grounding shell.

Figure 6:
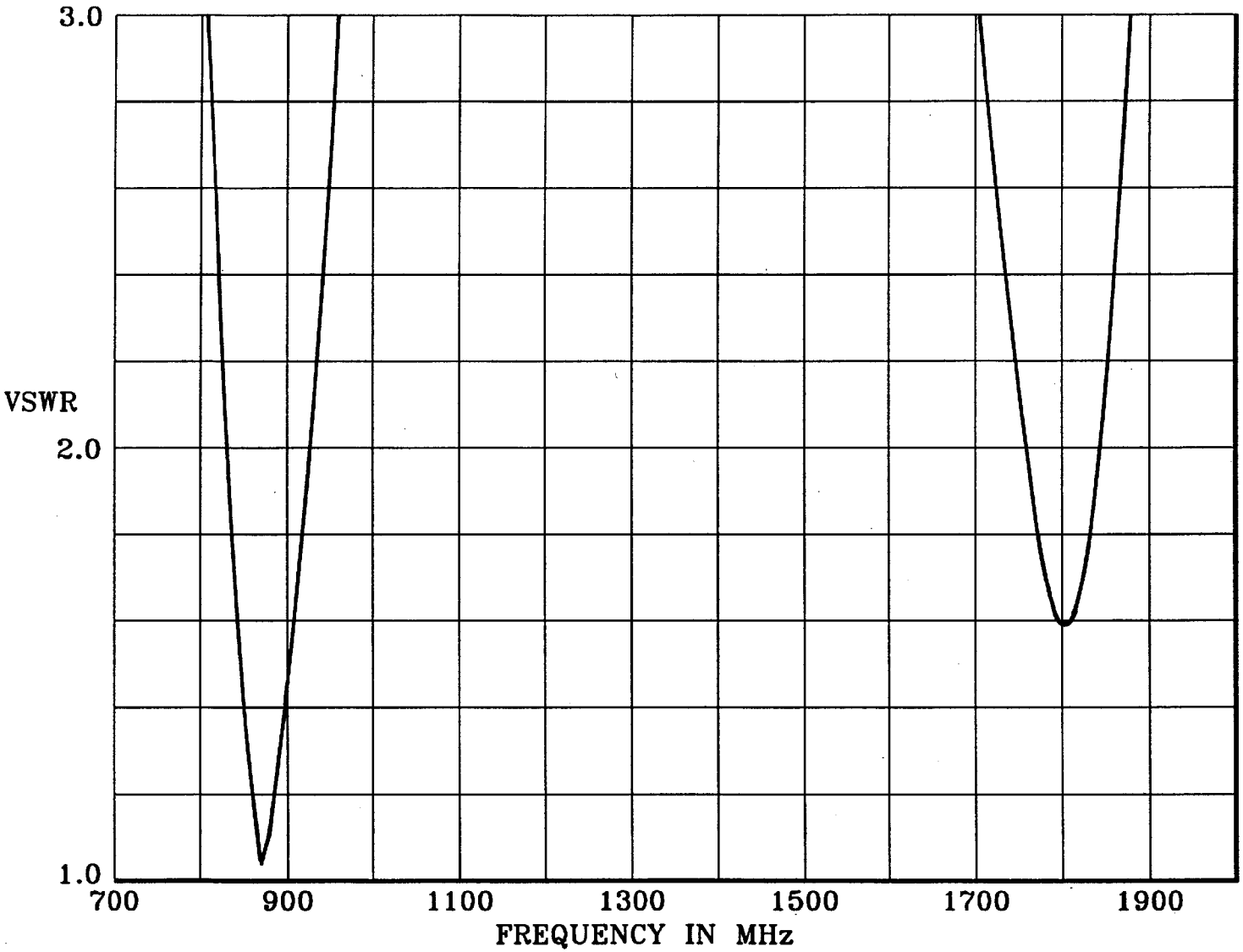
FIG. 6 is a graph of the VSWR for model calculations of the antenna shown in FIG. 4 and FIGS. 5*a* and 5*b*.

FIG. 6 graphs the voltage standing-wave ratio (VSWR) calculated according to the FDTD model for the antenna shown in FIGS. 4 and 5. FIG. 6 shows desired dips of the calculated VSWR at $f_1$=870 MHZ and $f_2$=1800 MHZ band centers. The operating bandwidth (having 2:1 VSWR or lower) is good, ranging from 829–923 MHZ at the lower band, and from 1760 –1844 MHZ at the upper band.

Figure 7:
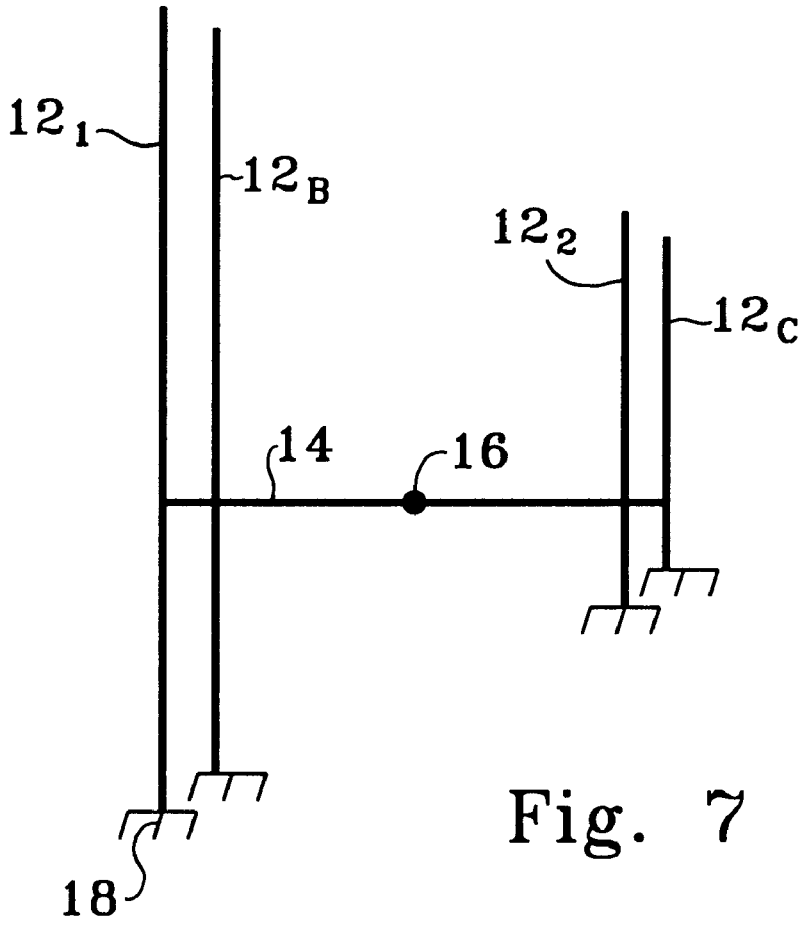
FIG. 7 is a schematic view of a broad dual band embodiment of the invention.

A broad banding solution realized by the invention is schematically illustrated in FIG. 7, for a two broad bands. The band of primary elongate radiator elements $\mathbf{12}_1$ and $\mathbf{12}_2$ is broadened by respective companion elongate radiator elements $\mathbf{12}_B$ and $\mathbf{12}_C$, which are stagger tuned to a slightly different center frequency than their associated primary elongate radiator elements. Such band stagger or overlap is a simple way to broaden bands with the antenna of the invention. Of course, multiple companion elements of gradually longer and or shorter lengths may be used.

This antenna of the invention can replace external whip antennas now commonly used in portable communications devices such as cellular telephones, data terminals, and personal communications systems (PCS). The antenna is conformed on or within a thin dielectric that can be conformally mounted on or within the case of the portable device. This markedly shrinks the maximum dimensional span of the device, increases its ruggedness, and decreases its manufacturing cost. Further, multiple band embodiments of the present antenna permit automatic operation of the portable communication device on two or more frequency bands, a requirement for emerging technology that provides multiple services in a single portable unit. Modeling of the antenna of the invention indicates that it will meet or exceed accepted engineering standards for far-field antenna gain and pattern, radiated-power efficiency, and antenna bandwidth. Thus, performance of the antenna of the invention is at least comparable with whip style radiators, while the present antenna offers automatic banding capabilities, has a compact geometry, and has better ruggedness.

While various embodiments of the present invention have been shown and described, it should be understood that other modifications, substitutions and alternatives are apparent to one of ordinary skill in the art. Such modifications, substitutions and alternatives can be made without departing from the spirit and scope of the invention, which should be determined from the appended claims.

Various features of the invention are set forth in the appended claims.

What is claimed is:

1. An inverted-F multiband antenna mountable in association with surfaces included in a portion of a casing of a portable communication device, said portion being a portion typically kept away from a user's hand during operation, the antenna comprising the following elements conformed with dielectric material:

a ground plane;

a first elongate radiator element disposed generally opposite through most of its length to said ground plane, said first elongate radiator element having an open end separated from said ground plane and a ground end connected to said ground plane;

a second elongate radiator element disposed generally parallel to said first elongate radiator element and disposed generally opposite through most of its length to said ground plane, said second elongate radiator element having an open end separated from said ground plane and a ground end connected to said ground plane, said second elongate radiator element being longer than said first elongate radiator element; and a feed element commonly connected to said first and second elongate radiator elements between their respective open and ground ends.

2. The antenna according to claim 1, wherein said antenna connects to said portable communication device through a feed to said feed element which is grounded to said ground plane.

3. The antenna according to claim 1, wherein said dielectric material comprises low loss tangent dielectric material.

4. The antenna according to claim 1, wherein at least said ground plane and said first and second elongate radiator elements are within said dielectric material.

5. The antenna according to claim 1, wherein at least said ground plane and said first and second elongate radiator elements are on a surface of said dielectric material.

6. The antenna according to claim 1, wherein a footprint of said ground plane encompasses and is slightly larger than a footprint of said first and second elongate radiator elements.

7. The antenna according to claim 1, wherein said feed element divides said first and second elongate radiator elements between their respective ground and open ends such that inductive admittance due to respective shorted ends of said first and second elongate radiator elements between their respective feed and ground ends is approximately canceled by the capacitive admittance due to the respective open-circuited ends of said first and second elongate radiator elements between their respective feed and open ends.

8. The antenna according to claim 1, wherein said first and second elongate radiator elements are commonly oriented with a back surface of the portable communication device which typically faces away from a user during operation.

9. A N-band inverted-F antenna conformed with dielectric material having two sides separated by distance, and a perpendicular region connecting the two sides, the antenna comprising:

a ground plane conformed with a first one of said two sides;

N generally parallel elongate radiator elements conformed primarily with the other of said two sides and grounded to the ground plane through the perpendicular region, a taper in relative length of said N generally parallel elongate radiator elements from open ends to ground ends thereof being approximately inversely proportional with their respective frequencies of operation;

a feed element generally perpendicular to said N generally parallel elongate radiator elements and commonly connected to said N generally parallel elongate radiator elements between their respective open and ground ends.

10. The antenna according to claim 9, wherein length of any one of said N elongate radiator elements is approximately defined by $l_k = l_1 * (f_1/f_k)$, where $l_k$ is the length of said one of said N elongate elements, $l_1$ is the length of the elongate radiator element having a lowest frequency band of operation, $f_1$ is the center frequency of the lowest frequency band of operation, and $f_k$ is the center frequency of operation of said one of said N elongate radiator elements.

11. The antenna according to claim 9, wherein length of any one of said N elongate radiator elements is less than a quarter wavelength of a center frequency of its frequency band of operation.

12. The antenna according to claim 11, where said length of any one of said N elongate radiator elements is approximately equal to the average of electrical quarter wavelengths at said center frequency in the air and within the dielectric material.

13. The antenna according to claim 9, wherein said dielectric material comprises low loss tangent dielectric material.

14. The antenna according to claim 9, wherein at least said ground plane and said N elongate radiator elements are within said dielectric material.

15. The antenna according to claim 9, wherein at least said ground plane and said N elongate radiator elements are on a surface of said dielectric material.

16. The antenna according to claim 9, wherein a footprint of said ground plane encompasses and is slightly larger than a footprint of said N elongate radiator elements.

17. The antenna according to claim 9, wherein said feed element divides said N elongate radiator elements between their respective ground and open ends such that inductive admittance due to respective shorted ends of said N elongate radiator elements between their respective feed and ground ends is approximately canceled by the capacitive admittance due to the respective open-circuited ends of said N second elongate radiator elements between their respective feed and open ends.

18. An inverted-F broad band antenna for a portable communication device, the antenna comprising:

a ground plane;

a primary elongate radiator element disposed generally opposite through most of its length to said ground plane, said primary elongate radiator element having an open end separated from said ground plane and a ground end connected to said ground plane;

a companion elongate radiator element disposed generally parallel to said primary elongate radiator element and generally opposite through most of its length to said ground plane, said companion elongate radiator element having an open end separated from said ground plane and a ground end connected to said ground plane, said companion elongate radiator element being stagger tuned by its length relative to said primary elongate radiator element;

a feed element connected to said primary and companion elongate radiator elements between their respective open and ground ends, wherein at least said ground plane and said primary and companion elongate radiator elements are conformed with dielectric material.

19. The antenna according to claim 18, wherein said dielectric material comprises low loss tangent dielectric material.

20. The antenna according to claim 18, wherein at least said ground plane and said primary and companion elongate radiator elements are within said dielectric material.

21. The antenna according to claim 18, wherein at least said ground plane and said primary and companion elongate radiator elements are on a surface of said dielectric material.

22. The antenna according to claim 18, wherein a footprint of said ground plane encompasses and is slightly larger than a footprint of said primary and companion elongate radiator elements.

23. The antenna according to claim 18, wherein said feed element divides said primary and companion elongate radiator elements between their respective ground and open ends such that inductive admittance due to respective shorted ends of said primary and companion elongate radiator elements between their respective feed and ground ends is approximately canceled by the capacitive admittance due to the respective open-circuited ends of said elongate radiator element between their respective feed and open ends.

* * * * *

UNITED STATES PATENT AND TRADEMARK OFFICE

CERTIFICATE OF CORRECTION

PATENT NO. : 6,292,144 B1
DATED : September 18, 2001
INVENTOR(S) : Taflove et al.

It is certified that error appears in the above-identified patent and that said Letters Patent is hereby corrected as shown below:

Title page,
Item [56], References Cited, please insert -- Nokia Cell Phone, Model 3210 with Internal Antenna (drawing) --.

Signed and Sealed this

Thirtieth Day of July, 2002

*Attest:*

*Attesting Officer*

JAMES E. ROGAN
*Director of the United States Patent and Trademark Office*